United States Patent [19]

Inculet et al.

[11] 4,357,234

[45] Nov. 2, 1982

[54] ALTERNATING POTENTIAL ELECTROSTATIC SEPARATOR OF PARTICLES WITH DIFFERENT PHYSICAL PROPERTIES

[75] Inventors: Ion I. Inculet; Yuji Murata, both of London, Canada

[73] Assignee: Canadian Patents & Development Limited, Ottawa, Canada

[21] Appl. No.: 264,598

[22] Filed: May 18, 1981

[51] Int. Cl.[3] ..... B03C 7/04

[52] U.S. Cl. ..... 209/127 B; 209/128

[58] Field of Search ..... 209/1, 127 R, 127 A, 209/127 B, 128, 131, 130, 129; 204/164, 180 R, 186

[56] References Cited

U.S. PATENT DOCUMENTS

| | | | |
|---|---|---|---|
| 1,154,907 | 9/1915 | Bibolini et al. | 209/128 |
| 2,699,869 | 1/1955 | Gear | 209/127 C |
| 2,848,108 | 8/1958 | Brastad et al. | 209/127 R |
| 3,162,592 | 12/1964 | Pohl | 209/127 R X |
| 3,720,312 | 3/1973 | Shook et al. | 209/127 R X |

*Primary Examiner*—Ralph J. Hill

*Attorney, Agent, or Firm*—Edward Rymek

[57] ABSTRACT

The separator charges the particles to be separated and passes them through an alternating electric field which has a non-uniform intensity in a direction perpendicular to the forward direction, and which also has field lines curved in the same direction. The particles which move along the curved field lines due to their charge are thus subjected to a centrifugal force which effects their separation. The separator includes a pair of conductive electrodes, the first being substantially horizontal or possibly at an angle from the horizontal and the second mounted facing the first at a predetermined angle to it. The electrodes may be planar or curved. The field is supplied by an ac source operating in the range of 3 to 1000 hz. A mechanical vibrator attached to the first electrode imparts the forward motion to the particles.

16 Claims, 11 Drawing Figures

ALTERNATING POTENTIAL ELECTROSTATIC SEPARATOR OF PARTICLES WITH DIFFERENT PHYSICAL PROPERTIES

BACKGROUND OF THE INVENTION

This invention is directed to the electrostatic separation of particles having different physical properties and in particular to the separation of particles using an alternating potential field.

Many industrial mechanical and electrostatic methods exist for the separation of granular solids. The mechanical methods which include screening apparatus and fluidized beds are particularly useful if the size of the particles differ appreciably or if the specific gravity of the components of the granular mixture differ. The electrostatic separators which use high voltage fields operate to attract or repel certain particles and are particularly useful for mixtures in which the particles differ substantially in charge. These systems have been found to become quite complex for mixtures having more than two components and it has been found that several passes are necessary to provide an acceptable separation of the components.

SUMMARY OF THE INVENTION

It is therefore an object of this invention to provide an electrostatic separator for particles having different physical properties such as levels of conductivity, sizes, or densities.

This and other objects are achieved by charging the particles and driving them in a forward direction through an alternating electric field which has a non-uniform intensity in a direction perpendicular to the forward direction, and which has field lines curved in the same perpendicular direction. The particles which move along the curved field lines due to their charge are thus subjected to a centrifugal force in the perpendicular direction. The centrifugal force on each particle depends on the mass, the size, and the electric charge of the particle and thereby different particles are separated along this perpendicular direction. The particles are charged by triboelectrification and/or by conductive induction. The forward motion of the particles may be imparted by mechanical vibration. The alternating field may be made to oscillate at a frequency of 3 to 1000 hz.

The electrostatic separator for the particles having different physical properties includes a first and second conductive electrode structure, each having a surface area of predetermined length and width. The second electrode structure is spaced from the first such that a voltage applied between the electrode surfaces will produce an electric field of non-uniform intensity along the width of the electrodes and the field will also have field lines curved in the direction of the width of the electrodes. A power source of predetermined voltage and frequency is used to apply the voltage between the electrodes. The particles to be separated are made to flow onto the surface at one end of the first electrode in an area of high field intensity, and are driven through the electric field along the length of the electrodes. Both the first and second electrode structures may have substantially planar surfaces mounted to form an angle between the surfaces along the width of the electrodes. However, according to other aspects of this invention, the first electrode structure may have a substantially planar surface and the second electrode structure may have a curved surface, the surfaces being mounted to have a constant cross-section along the length of the electrodes.

In accordance with another aspect of this invention, the first electrode surface may be substantially horizontal along its length and width. However, it may also be tilted along its width in the direction of the highest field intensity.

The separator may further include a layer of dielectric material mounted on the surface of the second electrode between the first and second electrodes.

To drive the particles in the forward direction, a mechanical vibrator may be fixed to the first electrode structure.

Many other objects and aspects of the invention will be clear from the detailed description of the drawings.

DETAILED DESCRIPTION

Figure 1:
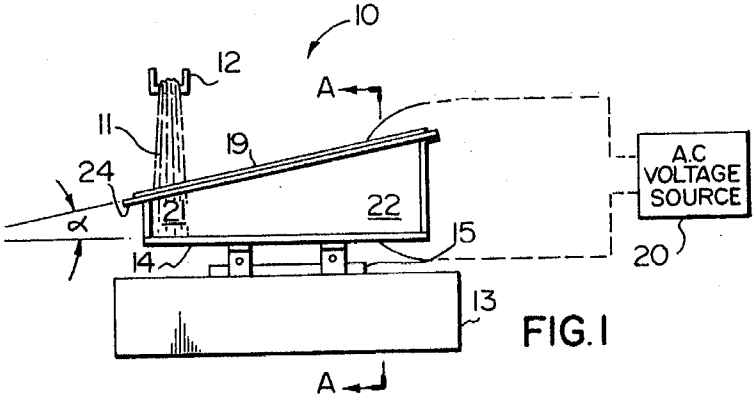
FIG. 1 is a front view of the separator.
Figure 2:
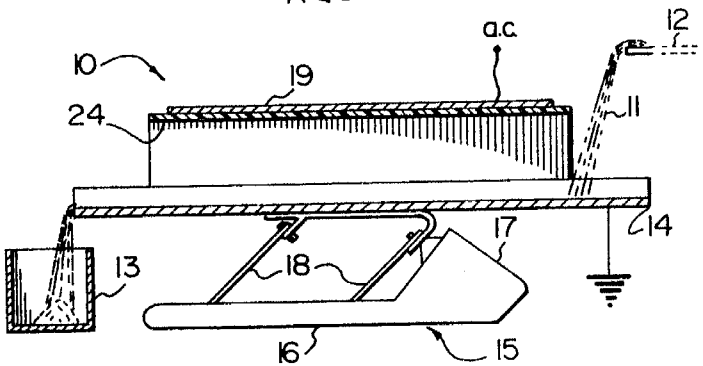
FIG. 2 is a cross-section of the separator in FIG. 1.

The electrostatic separator 10 in accordance with the present invention and as shown in FIGS. 1 and 2, receives a continuous flow of particles 11 to be separated from a source 12. The particles are separated as they move along its length and are deposited in separate collection bins 13.

The separator 10 has a first electrode 14 which is a planar conductive plate onto which the particles 11 fall. The particles 11 are made to move along the length of electrode 14 by a conventional vibratory feeder 15, such as a Syntron TM feeder. The feeder 15 includes a base 16, a vibrating drive 17, and flexible springs 18 attached to plate 14. As the vibratory feeder 15 vibrates, particles are driven from right to left along the electrode 14. The vibratory feeders 15 are normally electrically controlled such that the flow rate can be adjusted.

A second electrode 19 is mounted above the first electrode 14. As shown in FIGS. 1 and 2, electrode 19 may also be a planar conductive plate, however, it is mounted at an angle $\alpha$ to the first electrode 14, such that the spacing 21 between the electrodes 14 and 19 along one side of the separator is narrow and the spacing 22 on the other side of the separator 10 is wide. A dielectric plate 24 or layer would normally be mounted under electrode 19 to prevent discharges from occurring between the electrodes, however, both of the electrodes 14 and 19 may have a dielectric coating.

In operation, the electrodes 14 and 19 are connected to a high voltage ac source 20 which produces an alternating field between the electrodes. If particles 11 are charged as they move along the length of the separator 10, they will also move up and down freely between the two electrodes 14 and 19 following the electric field lines. This is due to the electric field which imposes an electrostatic force $F_{ele}=Q\times E$ on the particles, this force changes direction because of the alternating field. The particles with the greatest charge will have the largest $F_{ele}$.

However, due to the angle $\alpha$ between the electrodes 14 and 19, the field lines 30 are arcs of $\alpha$ degrees. The charged particles follow these curved lines and are therefore placed in a circular motion which has the effect of placing a centrifugal force $F_{cent}=v^2/r$ on the particles. r is the effective radius of the arcs and is larger for the particles which move to the wide side 22. This centrifugal force causes the particles to move outwardly but $F_{cent}$ on a particle becomes smaller as it does. Thus the higher the particles are charged, the further they will move to the wide side 22 of the separator. It also follows that the smaller or the less dense the particles are per unit charge, the further they will move to the wide side 22. Thus the separation will be a result of the differences in charges due to the various physical properties of the materials. Particle charging may be achieved by triboelectric or contact electrification, ion or electron bombardment, or conductive induction. In the embodiment shown in FIG. 1, triboelectrification and conductive induction are the major methods of particle charging.

It has been determined that a number of parameters in the system may be adjusted or varied to suit the materials being separated or beneficiated. For example, the size of the separator 10, i.e. the length and width of the electrodes 14 and 19 will be one factor in determining the amount of separation achieved. In a particularly long separator, collector bins may be placed on the sides of the separator 4 along its length to collect various separated fractions. The rate at which the materials are processed will be another factor. In addition, electrode 14 may be tilted slightly to the narrow side 21 such that the heavier particles will remain on this side.

Figure 3:
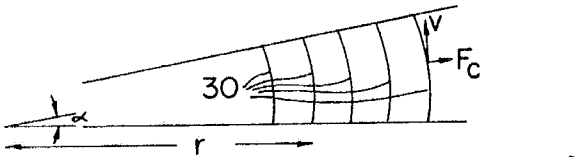
FIG. 3 illustrates the curved electric field lines between the electrodes.
Figure 4:
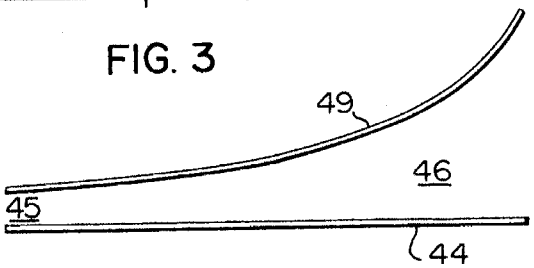
FIGS. 4 and 5 illustrate electrode embodiments.

Electrode 19 may take on a range of shapes just as long as the field lines remain curved to one side such that the centrifugal force on the particles will always be in the same direction. FIG. 4 illustrates a pair of electrodes 44 and 49 wherein the first electrode or base electrode 44 is substantially planar and the second electrode 49 has a cross-section which follows an exponential curve. This electrode arrangement separates the particles having a small charge, or large size or mass, into a succession of fractions starting at the narrow side 45. The particles having a large charge, or small size or mass, will be driven to the wide side 46 at the right.

Figure 5:
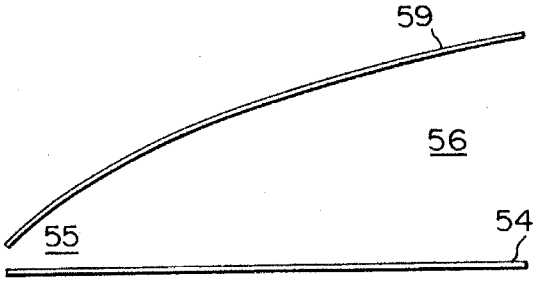

FIG. 5 illustrates an electrode arrangement wherein the base electrode 54 is planar and the second electrode 59 has a cross-section which traces a logarithmic type of curve. This electrode arrangement causes the small charge, or large size or mass particles to remain at the narrow side 55. The large charge, or small size or mass particles will separate into a succession of fractions along the width of the electrode towards the wide side 56. Though the cross-section of the electrode has been shown as being constant along the length of the separator, this need not be the case. The cross-section may vary along the length to accommodate special materials which may need different separation forces as the particles move through the separator. In addition, the base electrode 54 may also be curved to direct the bouncing of the particles and enhance the centrifugal forces.

As stated above, the parameters of the system may vary to suit the materials to be separated. This also applies to the voltage and frequency of the power source. For example, for fly ash-carbon beneficiation, a voltage of 5 to 8 kv at a frequency of 10 to 20 hz has been found to give good results, particularly with the angle $\alpha$ between the electrodes set at 12°. For the separation of glass beads, a voltage in the order of 5 kv at a frequency of approximately 50 hz was found to provide satisfactory results.

Generally, the voltage and frequency of the power source will be dictated by the size, density, and charge of the particles to be separated. The largest or most dense particles will leave the separator at the narrow side, and an increase in the size or the density of the particles in a mixture would dictate an increase in the voltage and a decrease in the frequency for proper separation. On the other hand, the particles with the strongest charge will move toward the wide side of the separator, and an increase of the particle charge will dictate a decrease in voltage and an increase in frequency for proper particle separation.

Separation of fly ash-carbon samples was achieved in a separator having planar electrodes 14 and 19 mounted at an angle $\alpha$ of 12°. Electrode 14 was made of a copper sheet approximately 8.5 cm wide and 35 cm long, while electrode 19 was made of an aluminum sheet approximately 10 cm wide and 28 cm long. An alternating voltage of 7 kv at 20 hz was applied between the electrodes. The results are shown on the beneficiation curves in FIGS. 6 to 11.

Figure 7:
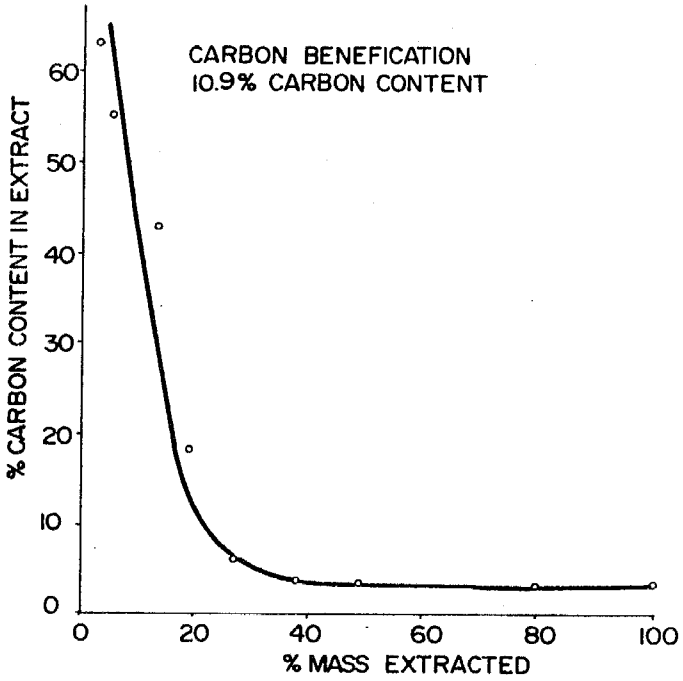
FIGS. 7, 9 and 11 are carbon beneficiation curves for the different fly ash-carbon samples.
Figure 8:
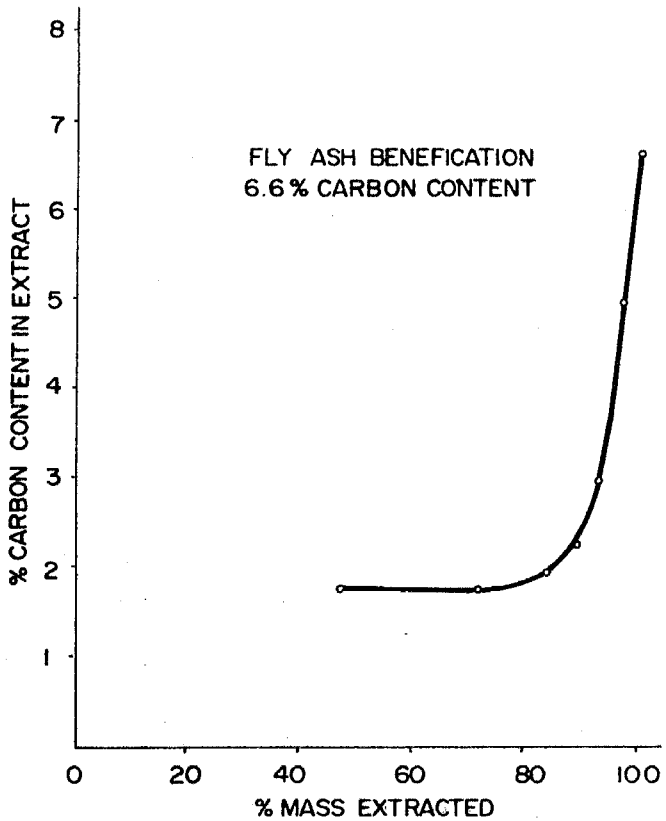
Figure 9:
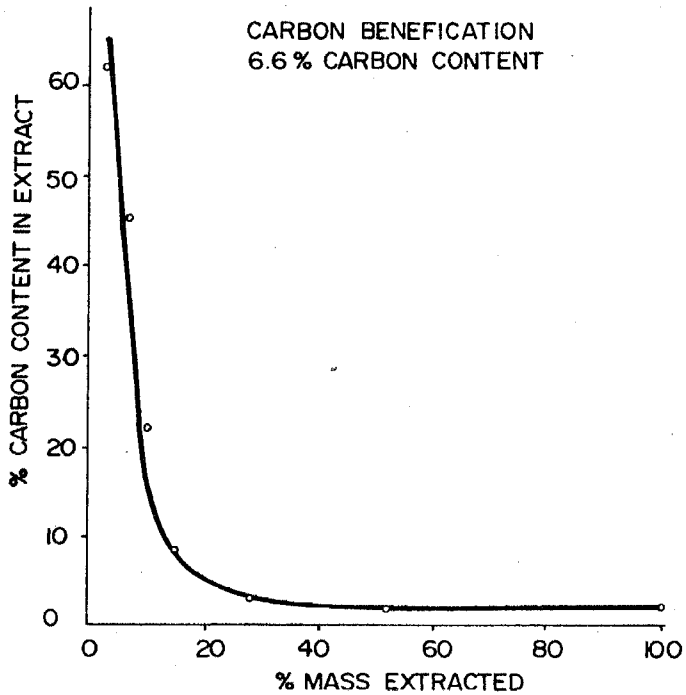

FIGS. 6 to 11 are beneficiation curves for a 10.9% carbon sample; FIGS. 8 and 9 for a 6.6% carbon sample; and FIGS. 10 and 11 for a 14.3% carbon sample. For the fly ash beneficiation curves in FIGS. 6, 8 and 10, the terms are defined as follows:

$$\%\text{ carbon content in extract} = \frac{\text{cumulative change in weight after ashing}}{\text{cumulative sample weight extracted}}$$

and $$\%\text{ mass extracted} = \frac{\text{cumulative weight of sample extracted}}{\text{total sample weight extracted}}$$

Figure 11:
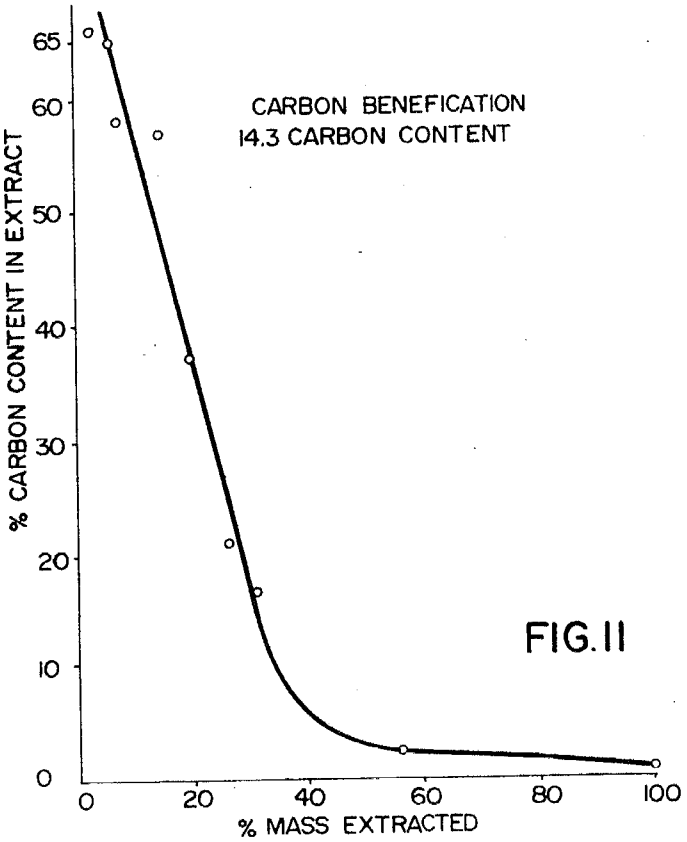
Figure 10:
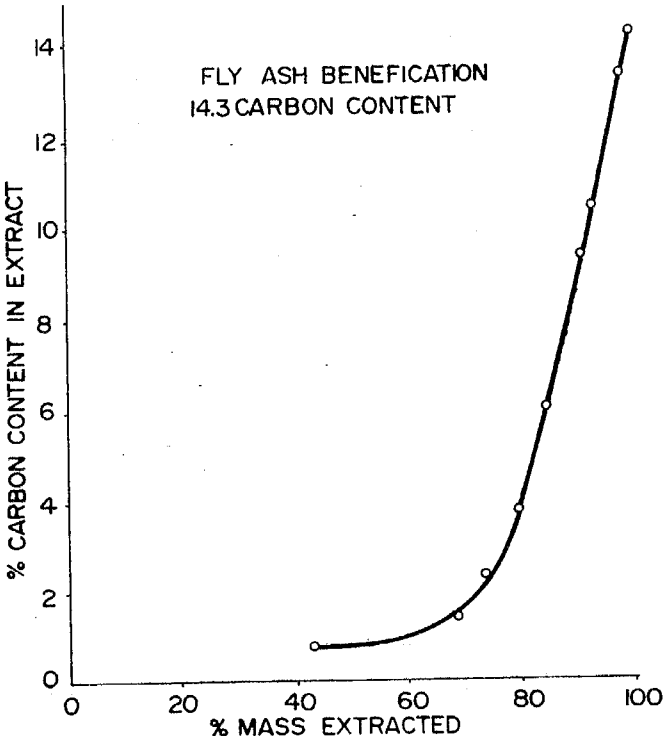

For the carbon beneficiation curves in FIGS. 7, 9 and 11, the terms are defined as follows:

$$\%\text{ carbon content in extract} = \frac{\text{change in weight after ashing}}{\text{weight of sample extracted}}$$

$$\%\text{ mass extracted} = \frac{\text{cumulative weight of sample extracted}}{\text{total sample weight extracted}}$$

Figure 6:
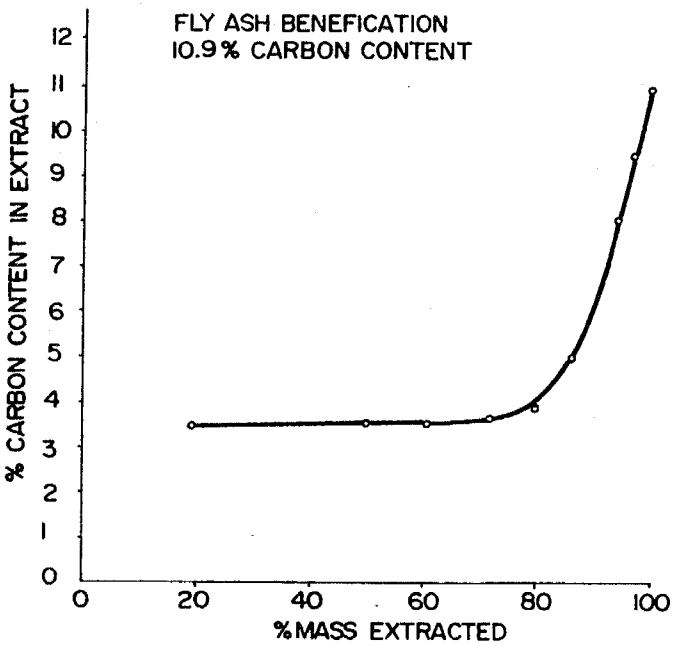
FIGS. 6, 8 and 10 are fly ash beneficiation curved for different fly ash-carbon samples.

The fly ash beneficiation curve in FIG. 6 shows the carbon reduction which can be achieved with respect to the percentage mass of fly ash extracted. For example, a reduction of about 67% of the initial carbon content can be achieved on 72% of the processed fly ash. The carbon content, which at the feed was about 10.9%, was reduced to about 3.5%.

The carbon beneficiation curve in FIG. 7 shows the possibility of obtaining very high percent carbon content in an extracted sample. Between 5 to 10% of the processed fly ash, may be obtained with a carbon content higher than 50%.

As seen in FIGS. 8 to 11, the results for the other two samples are very similar to that of the first sample. For the second sample, a 72% reduction of the initial carbon content was achieved on 75% of the processed fly ash. Here the feed contained about 6.6% carbon and it was successfully reduced to about 1.8%. As anticipated, only 3 to 5% of the processed fly ash had a carbon content higher than 50%. The third sample demonstrated a remarkable reduction of 94% in the carbon content of the processed fly ash. From FIG. 10, it shows that only 60% of the feed may attain this reduction. Due to the high initial carbon content, about 16% of the initial fly ash may be obtained with a carbon content in excess of 55%.

Many modifications in the above described embodiments of the invention can be carried out without departing from the scope thereof and, therefore, the scope of the present invention is intended to be limited only by the appended claims.

We claim:

1. A method of separating particles having different physical properties comprising:

charging the particles;

driving the particles in a forward direction through an alternating electric field of non-uniform intensity in a direction perpendicular to the forward direction and having field lines curved in the perpendicular direction whereby the particles are subjected to a centrifugal force in the perpendicular direction, the centrifugal force on each particle being dependent on the mass, size and electric charge of the particle whereby different particles are separated along the perpendicular direction.

2. A method as claimed in claim 1 wherein the particles are charged by triboelectrification.

3. A method as claimed in claim 1 wherein the particles are charged by conductive inductance.

4. A method as claimed in claim 1, 2 or 3 wherein the particles are driven in the forward direction by mechanical vibration.

5. A method as claimed in claim 1, 2 or 3 wherein the alternating field oscillates at a frequency between 3 and 1000 hz.

6. An electrostatic particle separator for particles having different physical properties comprising:

first conductive electrode means having a surface area of predetermined length and width;

a second conductive electrode means having a surface area of predetermined length and width wherein the second electrode is mounted in spaced relation with the first electrode means such that a voltage applied between the electrode means will produce an electric field of non-uniform intensity along the width of the electrode means and having field lines curved in the direction of the width of the electrode means;

power source means of predetermined voltage and frequency for applying the voltage between the electrode means;

means for introducing the particles to be separated unto the surface at one end of the first electrode means in an area of high field intensity; and means for driving the particles along the length of the electrode means.

7. A separator as claimed in claim 6 wherein the first and second electrode means have substantially planar surfaces mounted to form an angle between the surfaces along the width of the electrode means.

8. A separator as claimed in claim 6 wherein the first electrode means has a substantially planar surface and the second electrode means has a curved surface, the surfaces being mounted to have a constant cross-section along the length of the electrode means.

9. A separator as claimed in claim 6 wherein at least one of the electrodes has a curved surface.

10. A separator as claimed in claim 6, 7 or 8 wherein the first electrode means is substantially horizontal along its length and width.

11. A separator as claimed in claim 6, 7 or 8 wherein the first electrode means is substantially horizontal along its length and is tilted along its width in the direction of the highest field intensity.

12. A separator as claimed in claim 6, 7 or 8 which further includes a layer of dielectric material mounted on the inside surface of one or both electrodes.

13. A separator as claimed in claim 6, 7 or 8 wherein the driving means includes a mechanical vibrator fixed to the first electrode means.

14. A separator as claimed in claim 6, 7 or 8 wherein the power source operates at a frequency between 3 and 1000 hz.

15. A method of separating particles having different physical properties comprising:

charging the particles;

driving the particles in a forward direction through an alternating electric field having field lines curved in a direction perpendicular to the forward direction whereby the particles are subjected to a centrifugal force in the perpendicular direction, the centrifugal force on each particle being dependent on the mass, size and electrical charge of the particle whereby different particles are separated along the perpendicular direction.

16. An electrostatic particle separator for particles having different physical properties comprising:

means for generating an alternating electric field having a predetermined length and width, wherein the field lines are curved in the direction of the width of the field;

means for inserting the particles into one end of the electric field at the side away from the curvature of the field lines; and means for driving the particles through the electric field along the length of the electric field.

* * * * *